United States Patent [19]

Lee

[11] Patent Number: 5,072,150

[45] Date of Patent: Dec. 10, 1991

[54] SHADOW MASK ASSEMBLY FOR COLOR PICTURE TUBE

[75] Inventor: Woo-jong Lee, Seoul, Rep. of Korea

[73] Assignee: Samsung Electron Devices Co., Ltd., Rep. of Korea

[21] Appl. No.: 425,918

[22] Filed: Oct. 24, 1989

[30] Foreign Application Priority Data

Oct. 25, 1988 [KR] Rep. of Korea ..... 88-17251

[51] Int. Cl.[5] ..... H01J 29/07

[52] U.S. Cl. ..... 313/405; 313/406; 313/407

[58] Field of Search ..... 313/407, 405, 406

[56] References Cited

U.S. PATENT DOCUMENTS 3,710,165 1/1973 Tsuneta et al. ..... 313/407
4,670,687 6/1987 Gijrath et al. ..... 31/407 X
4,827,180 5/1989 Sone et al. ..... 313/407 X

FOREIGN PATENT DOCUMENTS 2603742 8/1977 Fed. Rep. of Germany ..... 313/407
2713765 10/1978 Fed. Rep. of Germany ..... 313/407

*Primary Examiner*—Palmer C. DeMeo
*Attorney, Agent, or Firm*—Leydig, Voit & Mayer

[57] ABSTRACT

A shadow mask frame for a color picture tube has side walls which are cut out to form cut-out sections, leaving only a plurality of bridge portions. A separate supporting means for the frame is provided in a direct contact with the shadow mask. According to the shadow mask frame of the present invention, the compensation period or the purity drift period from the starting of the operation of the color picture tube to the stabilization of the screen images will become very short.

3 Claims, 3 Drawing Sheets

FIG. 1
PRIOR ART
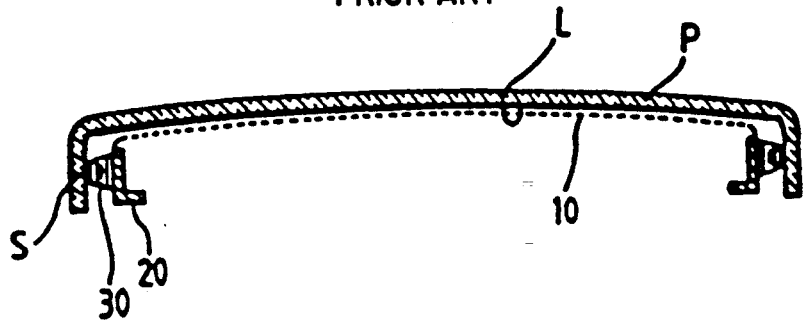
FIG. 3(A)
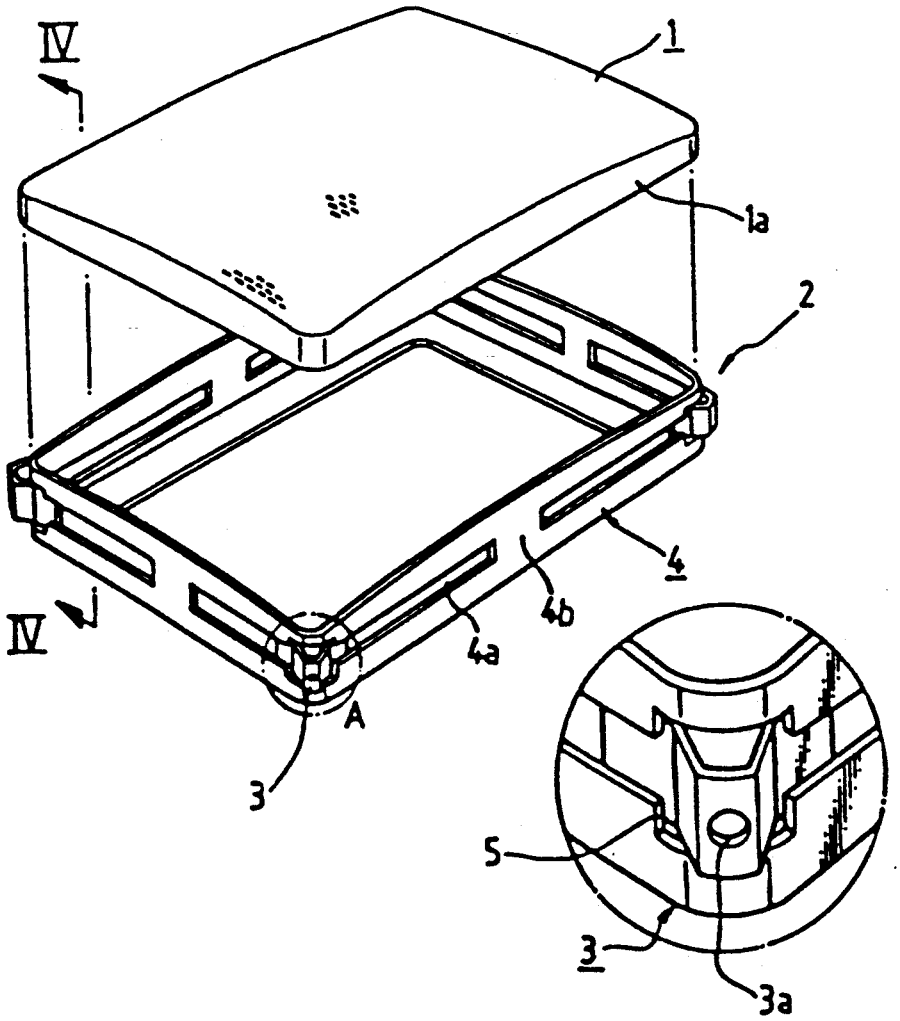
FIG. 3(B)

SHADOW MASK ASSEMBLY FOR COLOR PICTURE TUBE

FIELD OF THE INVENTION

The present invention relates to a shadow mask frame for a color picture tube, and particularly to a constitution and a suspension system of a frame assembly for supporting a shadow mask of a shadow mask type color picture tube.

BACKGROUND OF THE INVENTION

A shadow mask type color picture tube is provided with a shadow mask separated by a certain distance from the luminescent screen in order to selectively guide electron beams emitted from electron guns to the relevant positions on the luminescent screen formed on the inner face of the panel. This shadow mask is made of a thin metal sheet, is provided with numerous apertures, and is weld-fixed to a relatively rigid and heavy frame. The frame is supported by the panel through a proper suspension system or supporting structure.

As described above, the shadow mask is made of a thin metal sheet having countless extremely small apertures. Therefore, the electron beam passing rate is very low, with the result that about 80% of the energy of the electron beams is absorbed into the shadow mask to be converted into heat energy, thereby heating up the shadow mask and the frame. Accordingly, the shadow mask and the frame on which the shadow mask is weld-fixed undergo thermal expansions, with the result that the position of the shadow mask relative to the luminescent screen is displaced, and that the landing positions of the electron beams are deviated, thereby raising the so-called mislanding or purity drift problem.

A conventional shadow mask frame which is proposed in an attempt to overcome such a problem is illustrated in FIG. 1. This device is intended to compensate for the thermal expansion.

In this device, a plurality of hook springs 30 made of bimetals or involving bimetals are attached at a plurality of positions on the four sides of a frame 20 on which a shadow mask 10 is weld-fixed, and the hook springs 30 are respectively coupled with stud pins S installed on the inner circumference of the skirt portion of a panel P on which a luminescent screen L is formed.

The thermal expansion of such a conventional shadow mask frame and the compensation mechanism therefor will be described referring to FIG. 2.

In FIG. 2A, among the electron beams emitted from an electron beam emitting source G such as an electron gun, one electron beam (indicated by an arrow mark of solid line) is emitted in such a manner that it should pass an aperture Ma formed on the shadow mask 10, and should be landed at a point A of the luminescent screen L. Meanwhile, the shadow mask 10 is heated up and thermally expanded by the electron beams. The frame 20, which has relatively larger heat capacity, does not undergo a thermal expansion in the initial stage because heat conduction is not yet sufficient. Therefore, the frame 20 restricts the thermal expansion of the shadow mask 10, which has relatively smaller heat capacity. As a result, the shadow mask 10 is thermally deformed in the form of a dome toward the luminescent screen L. This is called the doming effect.

Accordingly, the aperture which has been at the position MA is displaced to another position MB, and the electron beam travels along the path indicated by a dotted arrow, and lands at another point B of the luminescent screen L, thereby causing a lowering of the color purity. This is called "initial purity drift".

If the color picture tube is continuously operated for a certain period of time, heat is conducted through the shadow mask 10 to the frame 20, and the frame 20 also undergoes thermal expansion. Then, as shown in FIG. 2(B), the frame 20 expands outwardly, while the shadow mask 10 which has been subjected to the doming effect substantially recovers the original curvature which it retained before being heated up. Under this condition, the shadow mask frame assembly thermally expands outwardly, and the aperture which has been at the position MB is displaced to another position MC, with the result that the electron beam travels along the path indicated by an arrow of alternating dashes and dots, and lands at a point C of the luminescent screen L. This is called "long term purity drift".

Thereafter, due to the heat energy conducted to the frame 20, the bimetals or the hook springs made of bimetals (not shown in FIGS. 2(A)-2(C) are heated, and the bimetals or the hook springs push the shadow mask frame assembly toward the luminescent screen L. Therefore, the aperture which has been at the position MC is displaced to another position MA' which is on the same scanning line as the aperture MA, and accordingly, the electron beam travels through the aperture MA' and lands at the point A of the luminescent screen L, which is the originally intended point, thereby achieving a correction for the thermal expansion or the purity drift.

Therefore, during the period of time when one of the apertures of the shadow mask 10 is drifting through the positions MA→MB→MC→MA', that is, during the period of time when the beam landing point is drifting through the points A→B→C→A, the color purity of the images on the screen becomes unstable. The shorter the unstable period, the better quality of images is obtained from a color picture tube.

However, the conventional frame 20 described above has too great a heat capacity compared with the shadow mask 10, and therefore, a long period of time is required until a sufficient thermal expansion and a thermal conduction are attained, with the result that the purity drift period is greatly extended. Further, the supporting structure for compensating the thermal expansion consists of the hook springs 30 which receives the thermal conduction through the side walls of the frame 20, and therefore, the period of time required for the compensation is very much extended. Thus the conventional color picture tube has the disadvantage that it consumes a long period of time before it is stabilized to clear images, i.e., to a sufficient color purity after the starting of its operation.

SUMMARY OF THE INVENTION

The present invention is intended to overcome the above described disadvantages of the conventional techniques.

Therefore it is the object of the present invention to provide a shadow mask frame for a color picture tube in which the purity drift period and the period of time required for the compensation are very short, and therefore, stabilized images can be promptly provided.

In achieving the above object, the idea of the present invention lies in the following fact.

The reason why the purity drift periods (the initial purity drift due to the doming effect and the long term purity drift due to the thermal expansion of the frame) are so extended lies in the fact that the frame construction is too heavy compared with the shadow mask, which is made of a porous thin metal sheet. As a result, there is a great difference between the heat capacities of the frame and the shadow mask. Therefore, the purity drift period can be reduced by decreasing the difference of the heat capacities between the shadow mask and the frame, specifically, by reducing the heat capacity of the frame so that the heat capacities of the shadow mask and the frame are approximately equal.

Further, if the period of time required for compensating the purity drift due to the thermal expansion is to be reduced, the suspension system or the support structure of the frame for achieving the compensation can be heated almost simultaneously with the heating of the shadow mask. That is, the frame support structure can be directly contacted to the shadow mask so that the heat is directly conducted between the frame support structure and the shadow mask.

The shadow mask frame of a color picture tube according to the present invention based on the above described idea comprises a shadow mask disposed in separation by a certain distance from a luminescent screen formed on an inner surface of a panel; and a frame for supporting the shadow mask, supported to the panel through supporting means, and for compensating the thermal expansion, wherein, cut-out portions are formed by cutting out portions of the side walls of the shadow mask frame, leaving only bridge portions.

Owing to such characteristics, the shadow mask frame according to the present invention gains the feature that the difference of the heat capacities between the shadow mask and the frame is reduced, and that the thermal conductions between the shadow mask and the frame are speedily carried out and the thermal expansion thereof is speedily realized. Therefore, the doming effect, the initial purity drift, the long term purity drift, and the compensation for the drift are completed within a short period of time due to the fast heat conduction.

Further, if the shadow mask frame of the present invention is constituted in such a manner that the supporting means for the frame is directly contacted with the shadow mask, the compensation for the drifts due to the thermal expansion can be achieved within a far shorter period of time.

BRIEF DESCRIPTION OF THE DRAWINGS

The above object and other advantages of the present invention will become more apparent by describing in detail the preferred embodiment of the present invention with reference to the attached drawings in which;

FIG. 1 is a schematic sectional view of a ordinary shadow mask frame assembly of a color picture tube;

FIGS. 3(B) and 3(A) are partially enlarged and partially exploded perspective views showing the constitution of the shadow mask frame according to the present invention;

DESCRIPTION OF THE PREFERRED EMBODIMENT

Figure 2A:
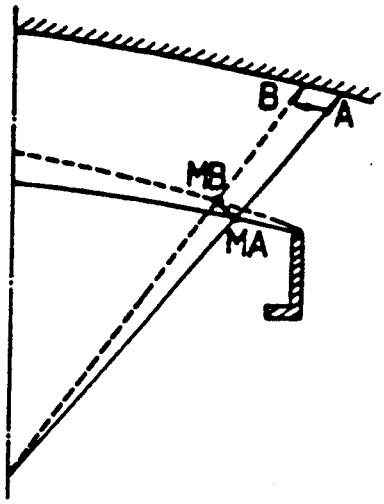
FIGS. 2(A), 2(B), and 2(C) illustrate the processes of the displacements of the shadow mask frame assembly during the emissions of electron beams.
Figure 2B:
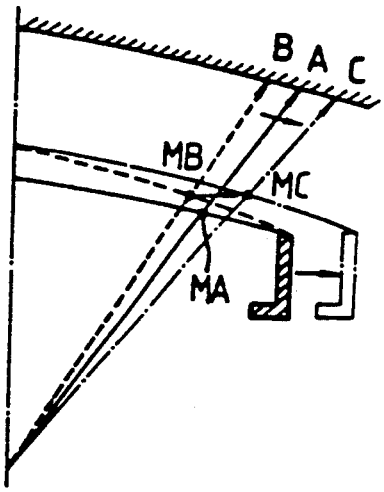
Figure 2C:
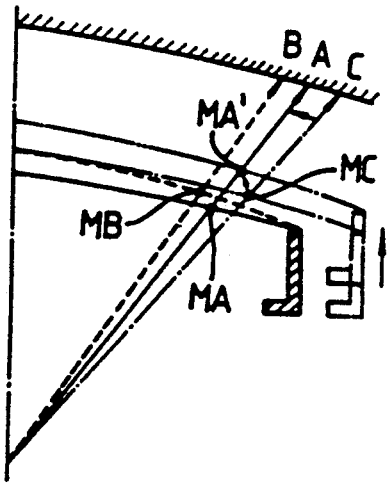

A shadow mask frame 2 according to the present invention as shown in FIG. 3 is provided with side walls 4 forming a rectangular contour. The side walls 4 are cut out in the direction of their lengths to form cut-out portions 4*a*, leaving only bridge portions 4*b* required for maintaining the rigidity of the frame 2.

A shadow mask 1 made of porous thin metal sheet is welded or otherwise fixed to the inside or outside of the side wall 4 of the frame 2, while the outside of the side wall 4 is provided with supporting means which are supported by and coupled with stud pins of the panel (not shown), and which are for compensating for the drifts due to thermal expansion.

The supporting means may consist of bimetals or hook springs involving bimetals, but they are desirably constituted as described below according to the present invention.

As can be clearly seen in the enlarged portion A of FIG. 3, supporting recesses 5 are respectively formed at the four corners of the side walls 4, and a Ω shaped spring body 3 provided with a coupling hole 3*a* is welded or otherwise fixed in such manner that it protrudes outwardly from the interior of each of the supporting recesses 5. The spring 3 may be made of a bimetal material as in the case of the hook springs, but it is also desirable that it be attached to the frame under the involvement of a separate bimetal material.

Figure 4:
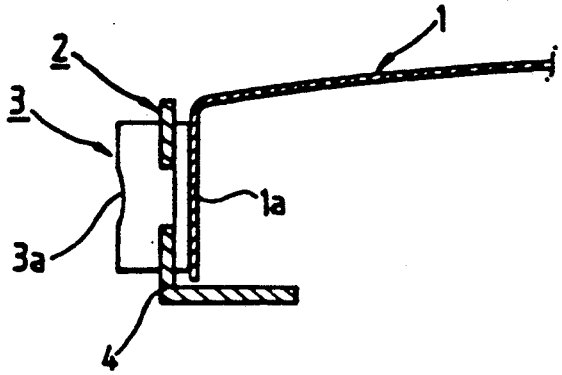
FIG. 4 is a partial sectional view taken along the line IV—IV of FIG. 3.

It is desirable that the spring 3 is disposed in such a manner as to directly receive the thermal conduction from the shadow mask 1. That is, as shown in FIG. 4, in a state with the spring 3 attached to the side wall 4 of the frame 2, the skirt portion 1*a* of the shadow mask 1 is inserted into the interior of the side wall 4 of the frame 2, so that the skirt portion 1*a* of the shadow mask 1 and the spring 3 are in direct contact with each other, the contacting portions being fixed by a suitable means such as welding. Here, the portions other than the welded portions should be in close contact with each other by bending either the skirt portion 1*a* of the shadow mask 1 or the side wall 4 of the frame 2, and welding the closely contacted portions together.

Figure 5:
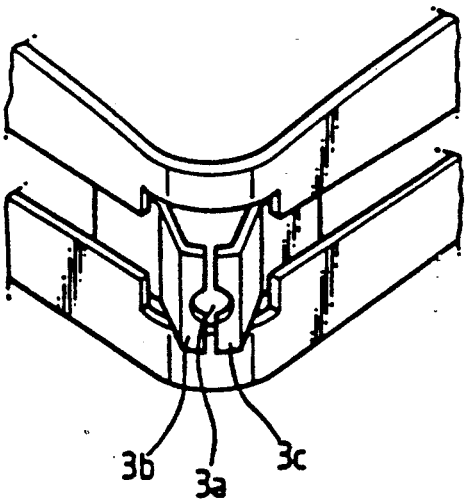
FIG. 5 is a fragmentary perspective view of another embodiment of the portion A of FIG. 3.

Meanwhile, the Ω shaped spring 3 is apt to be restricted for itself in its thermal deformation, and therefore, if free deformations of it are to be allowed, the spring 3 may be desirably made to consist of two divided springs 3*b*, 3*c* as shown in FIG. 5.

The shadow mask frame of the present invention constituted as above will now be described as to its operations.

If an electron beam emitted from an electron beam emission source (not shown) such as an electron gun arrives at the shadow mask 1, the electrons which have failed to pass the shadow mask 1 strike the shadow mask 1 and heat the shadow mask 1 up. Accordingly, the shadow mask 1 undergoes thermal expansion, and the heat is conducted to the nearby frame 2. However, the frame 2 is provided with the cut-out sections 4*a*, and therefore, the mass of the frame, i.e., the heat capacity of the frame 2, is significantly reduced. As a result the frame 2 is more speedily heated up and expanded compared with the conventional device. Consequently, the restriction of the deformation of the shadow mask 1 will not be severe, and the doming effect will not occur. Also, the period of the purity drift will be markedly shortened.

According to a preferred embodiment of the present invention, the spring body 3 for compensating the thermal expansion is disposed in direct contact with the skirt portion 1*a* of the shadow mask 1, so that the spring 3 should receive the thermal conduction directly, thereby making it possible to start the compensation for the thermal expansion within a short period of time after starting of the heating of the shadow mask 1, and completing the compensation within a short period of time.

Thus the adoption of the shadow mask frame according to the present invention will give the result that the compensation period or the purity drift period from the starting of the operation of the color picture tube to the stabilization of the screen images will become very short, and therefore, a high quality color picture tube capable of providing stabilized images within a short period of time can be manufactured.

What is claimed is:

1. A shadow mask assembly for a color picture tube panel comprising:

a shadow mask separated by a certain distance from a luminescent screen formed on an inner face of the panel;

a frame for supporting said shadow mask;

a plurality of supporting means for coupling said frame to said panel and made of bimental, each of said supporting means being located at each corner portion of the frame and formed with an aperture to receive a coupling pin fastened to the panel;

said frame having side walls which are cut out to form a plurality of elongated apertures formed around the corner portions of the side walls and lengthwise along the side walls, and a plurality of bridge portions between the apertures; and;

said supporting means being inserted in the elongated apertures and fixed to the frame.

2. The shadow mask assembly for a color picture tube as claimed in claim 1 wherein the supporting means are in direct heat conducting contact with said shadow mask.

3. The shadow mask assembly for a color picture tube as claimed in claim 2 wherein said shadow mask includes a skirt portion welded to said frame.

* * * * *